US006020815A

United States Patent [19]

Eslambolchi et al.

[11] Patent Number: 6,020,815

[45] Date of Patent: Feb. 1, 2000

[54] UTILITY RIGHT-OF-WAY SAFETY MONITOR

[75] Inventors: Hossein Eslambolchi, Basking Ridge, N.J.; John Sinclair Huffman, McDonough, Ga.

[73] Assignee: AT&T Corp, Middletown, N.J.

[21] Appl. No.: 08/879,846

[22] Filed: Jun. 20, 1997

[51] Int. Cl.[7] ..... G08B 1/08

[52] U.S. Cl. ..... 340/539; 340/905; 340/933; 340/988; 246/292

[58] Field of Search ..... 340/901–905, 340/908.1, 988, 998, 943, 539, 565, 566, 825.36, 825.45, 825.46; 367/197–199; 246/292–295, 473 R, 473.1

[56] References Cited

U.S. PATENT DOCUMENTS 5,406,256 4/1995 Ledel et al. ..... 340/539

5,713,540 2/1998 Gerzberg et al. ..... 246/121

*Primary Examiner*—Edward Lefkowitz

*Assistant Examiner*—Daryl C. Pope

*Attorney, Agent, or Firm*—Robert B. Levy

[57] ABSTRACT

A system (18 ) for warning workers in the vicinity of a transportation pathway (10 ), such as a railroad track, of the presence of an oncoming vehicle, includes a detector/transmitter assembly (20 ) for detecting the presence of an oncoming vehicle by sensing vibrations generated thereby. Upon detecting an oncoming vehicle, the detector/transmitter assembly broadcasts an RF signal to individual receivers (22 ). Each worker carries a receivers that receive the signal and generate an alert, in the form of a vibration and/or audible tone, to alert the worker of the approaching vehicle.

8 Claims, 1 Drawing Sheet

UTILITY RIGHT-OF-WAY SAFETY MONITOR

TECHNICAL FIELD

This invention relates to a method and apparatus for detecting the presence of a vehicle, especially a railroad locomotive, traveling on a railroad track alongside a utility right-of-way and for broadcasting a warning to workers in the vicinity of the right-of-way.

BACKGROUND ART

In many localities, utility cables, particularly fiber optic cables employed for carrying telecommunications traffic, are buried directly along side a railroad track or highway. Generally, land use planning guidelines require that roads and railroad tracks be buffered on opposite sides with unoccupied land for reasons of safety and for esthetics. Utilities, and particularly, telecommunications carriers find it advantageous to bury their cables along on such land, given that such land is otherwise vacant and there are often few barriers to burying cables underneath such lands.

Utility cable burial along side a road or railroad track poses a safety risk to utility technicians who must to maintain or repair such cables during intervals of vehicle and rail traffic, respectively. In practice, most of the noise associated with an oncoming vehicle will not be heard upstream of the vehicle. Hence, utility technicians working in the vicinity of a utility right-of-way parallel to a transportation pathway will not hear oncoming vehicles that pose a threat to worker safety. For that reason, the utility undertaking the maintenance or repair typically hires one or more workers whose sole responsibility is to flag any oncoming road or rail traffic to warn of the presence of utility technicians. In most instances, the entity responsible for the roadway or railroad track will insist on having its personnel flag down oncoming traffic. Consequently, the utility undertaking repairs of its buried cable must first make arrangements to obtain the necessary personnel to flag down oncoming traffic. Inevitably, the utility will bear the cost of such personnel who can be expensive.

There are electronic devices in the art for automatically detecting the presence of an oncoming vehicle, particularly a railroad train, by sensing the presence of the vibration created along the railroad track by the train. However, these devices are not believed effective alert individuals working along a railroad track of the presence of an oncoming train.

Thus, there is a need for a technique for providing a warning to personally alert individual utility technicians of the presence of an oncoming vehicle, (e.g., a motor vehicle or railroad train) traveling on a transportation pathway parallel to a utility cable right-of-way.

BRIEF SUMMARY OF THE INVENTION

Briefly, in accordance with the invention, a technique is provided for personally alerting each utility technician in the vicinity of a transportation pathway (e.g., a road or railroad track) of an oncoming vehicle, such as a motor vehicle or train, respectively. In accordance with the invention, the presence of the oncoming vehicle traveling on the transportation pathway is sensed, typically by sensing the vibrations in the transportation pathway caused by the vehicle. Upon sensing an oncoming vehicle, a radio frequency signal is broadcast. The signal is received by each utility worker via a pager or the like worn by the worker. In response to the signal, the pager generates a warning, typically in the form of a vibration and/or audible tone to alert the utility technician of the oncoming vehicle, allowing the technician to move a safe distance away.

DETAILED DESCRIPTION

Figure 1:
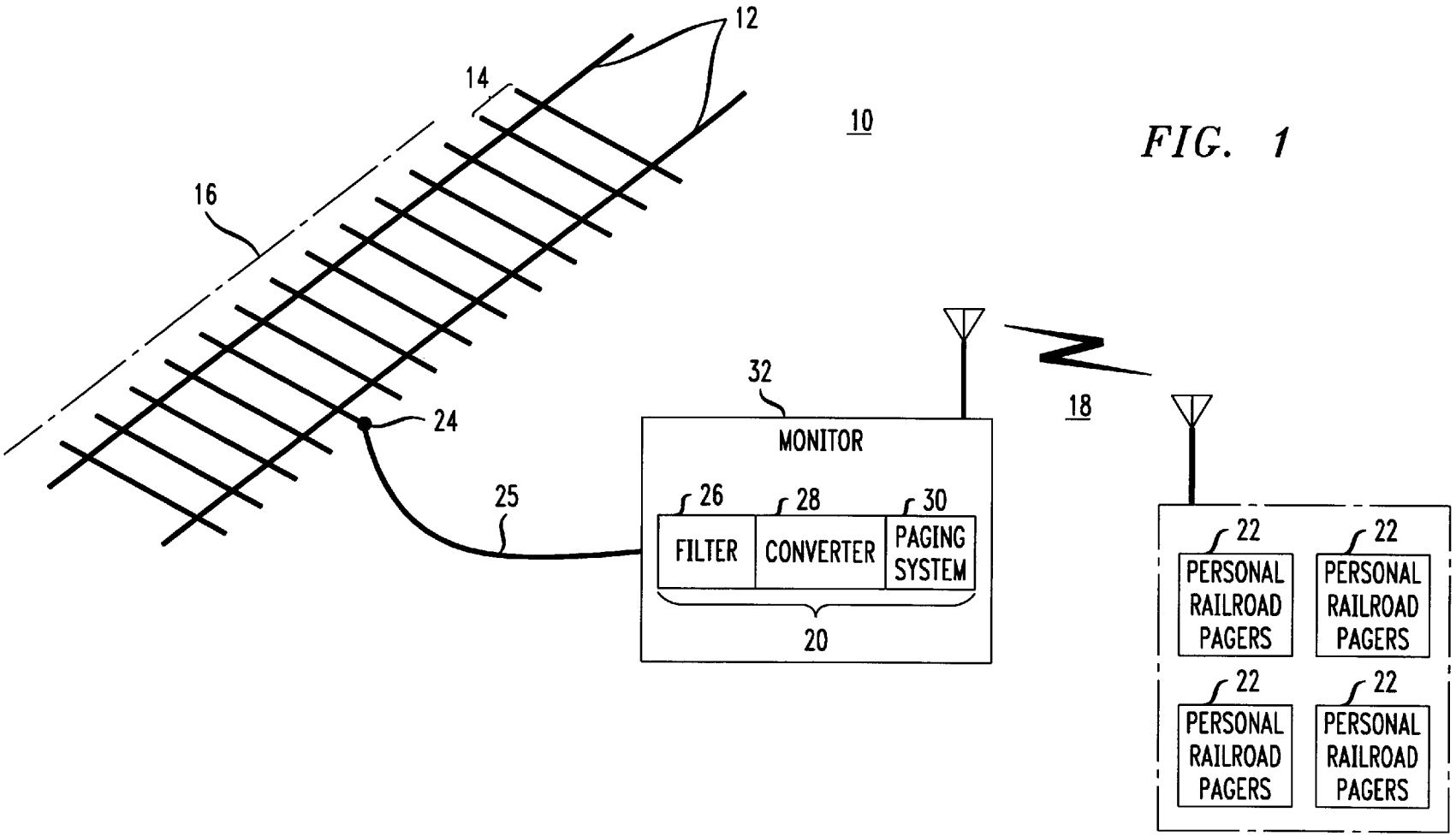
FIG. 1 is block schematic diagram of a utility right-of-way safety monitoring system in accordance with the invention.

FIG. 1 depicts a typical transportation pathway 10, which in the illustrated embodiment, comprises a railroad track traveled by a railroad train (not shown). The railroad track 10 is conventional in its construction, and includes a pair of parallel, spaced rails 12—12 supported by a plurality of spaced ties 14—14 that run orthogonal to the rails. Most localities require rail road racks, such as the rail road track 10 of FIG. 1, to be buffered on opposite sides with vacant land for reasons of safety and esthetics. Many utilities, and especially telecommunications carriers, often utilize the vacant land on opposite sides of the rail road track 10 to bury their underground cables, illustrated by the cable 16. The advantage of burying cables alongside the railroad track 10 is that there are few impediments, both physical and legal, that must be surmounted to effect cable burial.

During the cable burial process, as well as during subsequent repair and maintenance operations, oncoming railroad trains traveling on the railroad track 10 pose a potential danger to utility technicians in the vicinity of the track. In the past, this risk was mitigated by employing personnel from the railroad to flag down oncoming trains. While this approach is effective, it is inconvenient and expensive.

In FIG. 1, there is a system 18, in accordance with the present invention, for detecting the presence of an oncoming, a railroad train on the track 10 and for broadcasting a personal warning to each utility technician working in the vicinity of the track. The system 18 includes a combination detector/transmitter assembly 20 for sensing the presence of a train on the track 10 and for broadcasting a Radio Frequency (RF) signal indicative of the approaching train. The RF signal generated by the detector/transmitter assembly 20 is received by individual receivers 22—22, each worn by a utility technician working in the vicinity of the railroad track 10. In practice, each receiver 22 takes the form of a conventional pager that has the capability of receiving the signal from the detector/transmitter 20 and generating an alert, in the form of a vibration and/or audible tone. The vibration and/or tone generated by the pager 22 alerts the technician wearing the pager of the danger of an oncoming train so that the technician can take the necessary precautions. The use of a vibration that is felt by the utility technician is especially useful under noisy ambient conditions when an audible tone might not be heard.

The detector/transmitter 20 comprises a vibration detector 24 in the form of a microphone, strain gage, or other device, capable of detecting vibrations generated by an oncoming train traveling on the track 10. The vibration detector 24 is placed on or close to one of the rails 12—12 to detect the vibrations from an oncoming train. A cable 25 couples the vibration detector 24 to a filter 26 that filters the signal to eliminate spurious noise that might otherwise signal the presence of an oncoming train.

A converter 28 converts and thresholds the signal filtered by the filter 26 to yield a trigger signal of a preselected magnitude when the vibrations sensed by the vibration detector assembly 24, and filtered by the filter 26, exceed a prescribed threshold. This threshold corresponds to a vibration level indicative of an oncoming train. Note that the detector/transmitter assembly 20 can also be used to detect the vibrations attributable to an oncoming motor vehicle traveling along a road. Under such circumstances, a different threshold might be necessary that effectively distinguishes an oncoming motor vehicle.

The output signal of the converter 28 feeds a paging system 30, typically in the form of an RF transmitter, for broadcasting an alert signal for reception by the pagers 22—22. The RF signal could be broadcast at any frequency (assuming the pagers 22—22 were tuned to that frequency). For purposes of avoiding the need for FCC licensing, the RF signal may be broadcast at a low power level (<100 milliwatts) on that portion of the 49 MHz spectrum reserved for low power, unlicensed transmission. Moreover, to ensure enhanced signal clarity, the signal broadcast by the paging system 30 could be digitally encoded.

In practice, the major elements of the detector/transmitter assembly 24 (i.e., the filter 26, the converter 28 and the paging system 30) are contained in an enclosure 32 that also encloses a suitable DC power supply (not shown) as well as sufficient storage room for the vibration detector 24 and its associated cable 25. To protect the elements comprising the detector/transmitter assembly 24, the enclosure 32 is manufactured from a rugged material such as aluminum or plastic.

The foregoing describes an apparatus 18, and its method of use, for detecting the presence of an oncoming vehicle (e.g., railroad train) traveling on a transportation pathway (e.g., railroad track 10) and for broadcasting a personal warning to each utility technician working in the vicinity of the pathway.

It is to be understood that the above-described embodiments are merely illustrative of the principles of the invention. Various modifications and changes may be made thereto by those skilled in the art which will embody the principles of the invention and fall within the spirit and scope thereof.

What is claimed is:

1. A method for personally alerting a worker working in the vicinity of a transportation pathway of an oncoming vehicle traveling the pathway, comprising the steps of:

sensing if a vehicle is oncoming along the pathway by(a) detecting vibrations in the transportation pathway and generating a signal that varies accordingly, (b) filtering the signal, and thresholding the filtered signal to determine if the filtered signal exceeds a prescribed magnitude corresponding to the presence of an oncoming vehicle; and if so broadcasting a Radio Frequency signal indicative of the oncoming vehicle;

receiving the Radio Frequency signal on a receiver carried by each worker; and generating, by the receiver, an alert to the worker to warn of the oncoming vehicle.

2. The method according to claim 1 wherein the alert comprises a vibration generated by the receiver and felt by the worker.

3. The method according to claim 1 wherein the alert comprises an audible tone generated by the receiver.

4. The method according to claim 1 wherein the Radio Frequency signal is digitally encoded.

5. The method according to claim 1 wherein the radio frequency signals is broadcast in a frequency range of approximately 49 MHz and at a power level not greater than 100 milliwatts.

6. A system for personally alerting a worker working in the vicinity of a transportation pathway of an oncoming vehicle traveling the pathway, comprising:

means for sensing if a vehicle is oncoming by detecting vibrations in the transportation pathway and generating a signal that varies accordingly, along the pathway and for broadcasting a Radio Frequency signal indicative of the oncoming vehicle, including a filter for filtering the vibration signal; a converter for thresholding the vibration signal and for generating a trigger when the vibration signal exceeds a prescribed magnitude corresponding to the presence of an oncoming vehicle; and a paging system responsive to the trigger for broadcasting the Radio frequency signal; and means carried by the worker for receiving the Radio Frequency signal and for generating an alert to the worker to warn of the oncoming vehicle.

7. The system according to claim 6 wherein the alert generated by the receiving means comprises a vibration felt by the worker.

8. The system according to claim 6 wherein the alert generated by the receiving means comprises an audible tone.

* * * * *